United States Patent [19]

Schultz et al.

[11] Patent Number: 4,983,257

[45] Date of Patent: Jan. 8, 1991

[54] INVERT SIZE FOR THE INTERNAL AND SURFACE SIZING OF PAPER

[75] Inventors: Wolf-Stefan Schultz, Frankfurt; Uwe Beyer, Dreieich, both of Fed. Rep. of Germany

[73] Assignee: Klebstofwerke Collodin Dr. Schultz & Nauth GMBH, Frankfurt, Fed. Rep. of Germany

[21] Appl. No.: 294,834

[22] Filed: Jan. 9, 1989

Related U.S. Application Data

[63] Continuation of Ser. No. 87,537, Aug. 20, 1987, abandoned.

[30] Foreign Application Priority Data

Sep. 5, 1986 [DE] Fed. Rep. of Germany ..... 3630268

[51] Int. Cl.[5] ..... D21H 17/62

[52] U.S. Cl. ..... 162/158; 106/218; 106/236; 106/238; 162/166; 162/174; 162/175; 162/180

[58] Field of Search ..... 162/175, 180, 164.6, 162/166, 158, 174; 106/218, 236, 238

[56] References Cited

U.S. PATENT DOCUMENTS

| | | | |
|---|---|---|---|
| 2,393,179 | 1/1945 | Mashburn . | |
| 3,582,464 | 6/1971 | Aldrich | 162/175 |
| 3,906,142 | 9/1975 | Dowthwaite et al. . | |

FOREIGN PATENT DOCUMENTS

| | | |
|---|---|---|
| 1131348 | 6/1962 | Fed. Rep. of Germany . |
| 2426038 | 12/1975 | Fed. Rep. of Germany . |
| 2654496 | 6/1978 | Fed. Rep. of Germany . |
| 2845091 | 5/1980 | Fed. Rep. of Germany . |
| 7041018-1 | 8/1980 | Sweden . |

OTHER PUBLICATIONS

James P. Casey, "Papermaking", Pulp and Paper, 2nd ed., V. II, Chapter XIII, (1960), pp. 1043–1066.

*Primary Examiner*—Peter Chin

*Attorney, Agent, or Firm*—Sprung, Horn, Kramer & Woods

[57] ABSTRACT

An invert size for the engine and tub sizing of paper. It contains an aqueous dispersion of a fortified, unfortified, hydrogenated, or disproportionated and optionally esterified rosin or mixture of such rosins and of a dispersant that contains digested casein or an emulsifier of the general formula $$[R-(OCH_2CH_2)_n-O-A]_x^- \; M^{x+} \qquad (I)$$

wherein R is an alkylphenyl, alkyl, or alkenyl group or a cycloalkyl group with condensed rings, A is a group with the formula $-CH_2COO$ or $-SO_3$, $M^{x+}$ is a cation, x is 1 or 2, and n is a number such that approximately 21 to 76% of the molecular weight of the anion is in the $-OCH_2CH_2$ group. To allow sizing control, the dispersant also contains cationic starch.

11 Claims, 1 Drawing Sheet

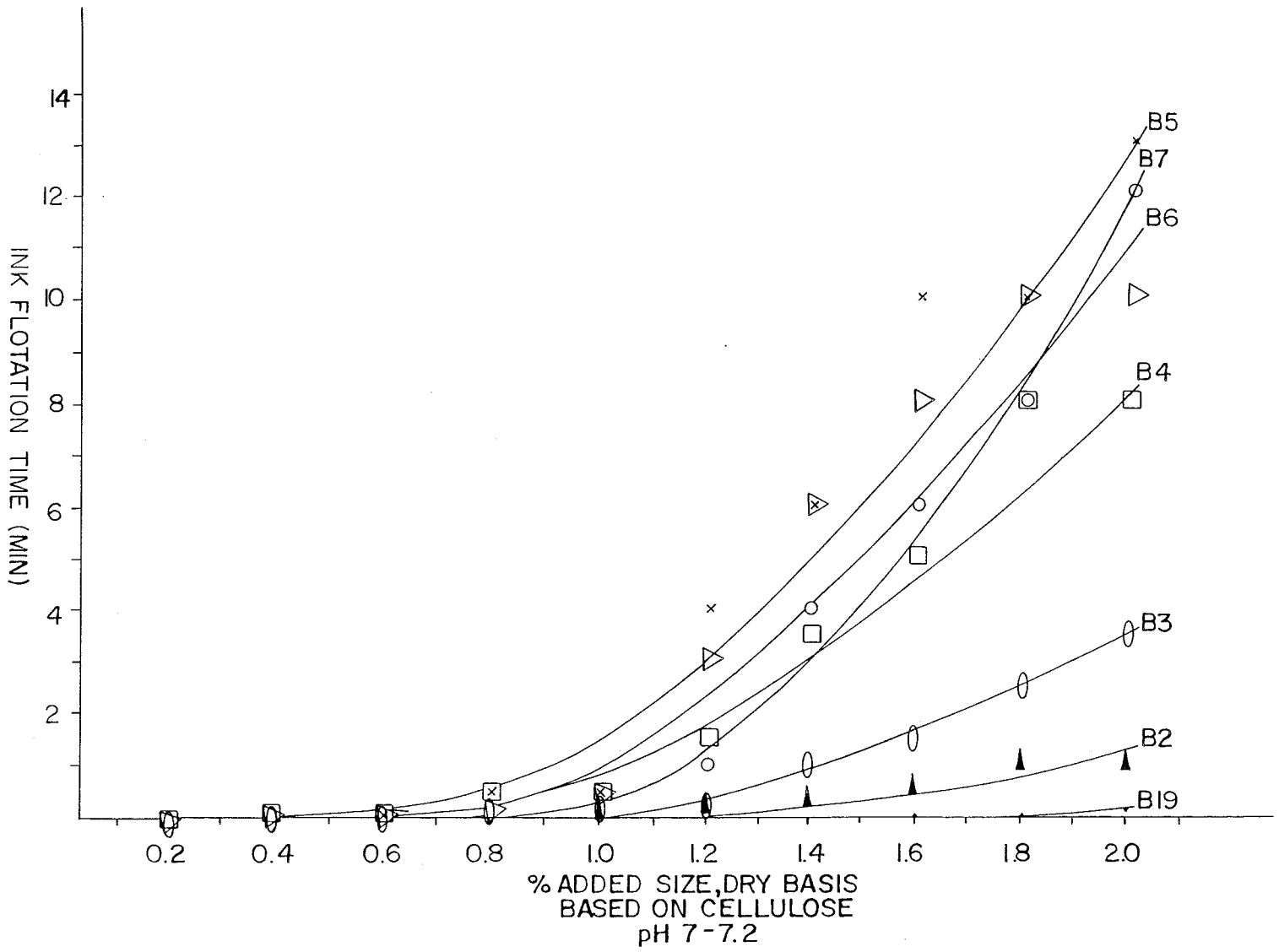
B5
B7
B6
B4
B3
B2
B19
0.2
0.4
0.6
0.8
1.0
1.2
1.4
1.6
1.8
2.0
% ADDED SIZE, DRY BASIS
BASED ON CELLULOSE
pH 7-7.2
14
12
10
8
6
4
2
INK FLOTATION TIME (MIN)

INVERT SIZE FOR THE INTERNAL AND SURFACE SIZING OF PAPER

This is a continuation of application Ser. No. 087,537, filed Aug. 20, 1987, now abandoned.

The invention concerns the invert size for the internal and surface tub sizing of paper.

The internal sizing of paper with rosin and with fortified rosin is described by Casey in *Pulp and Paper*, 2nd edition, Volume 2: Papermaking, Chapter XIII, pages 1043 to 1066. Fortified rosins can be prepared by reacting maleic anhydride or other dienophilic compounds with rosin while increasing the number of carboxylic-acid groups. A typical fortified size can contain approximately 1 to 30% maleinopinaric anhydride.

It is generally recognized that a size with a high level of free rosin results in better sizing and demands less alum. It is simultaneously possible to use a protective colloid to produce a very stable size containing up to 90% free rosin. The Bewoid process results in a size with a high percentage of free rosin that contains rosin dispersed in a small amount of rosin soap and stabilized with approximately 2% casein or another protein. The casein is employed as a protective colloid to prevent the particles of rosin from growing and to keep them finely divided. In the Bewoid process the rosin is mechanically divided in the presence of approximately 1 to 2% sodium hydroxide and approximately 2% casein. The solid rosin is heated and subjected to mechanical shearing strains until it is broken up into small particles. A small amount of sodium hydroxide (1.6 parts to 100 parts of rosin) is then added to the molten rosin to partly saponify it, followed by casein (2.0 parts dispersed in 0.2 parts of NaOH) to stabilize the dispersed particles of rosin. The dissolved casein is worked into the molten rosin while being powerfully stirred, subsequent to which a little more (0.2 parts) of NaOH is added, or the hot rosin melt is injected into water that contains casein. Finally, water is added to obtain a finished dispersion with approximately 45% solid particles, which is used in that form. This process is also called the "inversion method of manufacturing rosin size" and the resulting size "invert size."

The inversion method is employed in U.S. Pat. No. 2,393,179 to produce a size with free rosin, but with an alkaline dispersant, a sulfonated higher fatty alcohol for example, used instead of the sodium hydroxide. The rosin is melted, and the desired amount of dispersant added, accompanied by enough stirring to produce a homogeneous molten mass. A practically neutral or weakly acidic aqueous solution or dispersion of a protective colloid, casein for example, is then added gradually and accompanied by rapid stirring, resulting in a paste-like dispersion with a high solids content, which is then diluted with water to a solids content of 40 to 60% by weight.

In the Prosize method of producing a protected size with a high percentage of free rosin the particles of rosin are prevented from growing into large aggregates by the presence of a surface-active protein, soybean protein for example.

The sizes containing free rosin disclosed in German Patent No. 1 131 348 were dispersions of unsaponified resin acids with a specific percentage of resin soaps. The dispersions were obtained by the inversion method. They were usually employed with 60 to 95% free rosin plus auxiliary emulsifiers and stabilizers such as stearates, triethanolamine, casein, and waxes.

The fortified rosins in German Patent No. 1 131 348 have not until now been appropriate for producing dispersions because they usually had too high a melting point, tended to crystallize, or formed fine crusts that led to sedimentation when they dispersed. The patent describes a paper size and a method of manufacturing it in the form of an aqueous dispersion with a high content of free rosin wherein fortified rosin is mixed at elevated temperatures with fatty acids, mixtures of fatty acids, and/or naphthenic acids and the dispersion is carried out in a known way. The method was employed in the form of an inversion.

German OS No. 2 426 038 discloses a method of producing a practically stable aqueous dispersion of a material based on rosin and appropriate for sizing pulp-like fibers in the manufacture of paper, whereby an unstable aqueous dispersion that contained at least 5% solids consisting of 0 to 95% rosin and 100 to 5% of a reaction product of rosin with an acidic compound containing the group

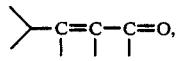

with the amount of the acidic compound bound in the form of an adduct being about 1 to 20% of the total solids weight, was homogenized at a pressure of approximately 142 to 563 bar and at a temperature of approximately 150° to 195° C. in the presence of an anionic dispersant. The dispersants were materials based on saponified rosin, sodium alkylbenzene sulfonate, sodium naphthalene sulfonic acid, sodium lauryl sulfate, or the ammonium salt of the sulfate ester of an alkylphenoxy(poly-ethyleneoxy)ethanol.

Swedish Patent Application No. 7 410 018-1 describes a practically stable aqueous dispersion consisting essentially of water, of rosin material, and of an alkali-metal alkylbenzene sulfonate to stabilize the rosin material. The dispersions are obtained by passing a previously prepared mixture of the components through a homogenizer.

U.S. Pat. No. 3,906,142 discloses an agent for sizing paper without using aluminum sulfate that contained a stable aqueous dispersion of a rosin fortified by reacting with an $\alpha,\beta$-unsaturated carboxylic acid or corresponding anhydride, a protective colloid, casein for example, and a volatile base, ammonia for example, whereby at least 90% of the fortified rosin was unsaponified. This agent was prepared with the inversion method, with the fortified rosin initially melted in a vessel equipped with a stirring and heating mechanism. A combination dispersant and stabilizer was then prepared in another vessel by dissolving measured amounts of a protective colloid, casein for example, and of a volatile base, ammonia for example, in water. The prepared dispersant and stabilizer was then rapidly added to the molten rosin, whereby high-speed stirring or another intensive method of blending was employed during and after the addition. Finally, the solids content of the resulting aqueous rosin dispersion was adjusted by adding a calculated amount of water.

An invert size for the engine sizing of paper is known from German OS No. 2 654 496. It contained an aqueous dispersion of a fortified rosin with a dispersant that yielded in solution anions of the formulas

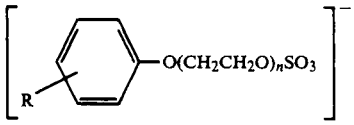

(II)

and $$[R'-O(CH_2CH_2O)_nSO_3]^- \quad \text{(III)}$$

wherein R was an n- or branched alkyl radical with 4 to 18 carbon atoms, R' was an alkyl, alkenyl, or cycloalkyl radical with condensed rings with 10 to 20 carbon atoms, and n was a number such that approximately 27 to 75% of the molecular weight was in the $CH_2CH_2O$ groups. Protective colloids, casein for example were not supposed to be necessary to manufacture this known paper size, although the inversion water had to be hot.

German OS No. 2 845 091 discloses an invert size for the internal and surface sizing of paper that contained dispersants in the aqueous resin dispersion in the form of compounds that yielded in solution or dispersion anions of the formulas

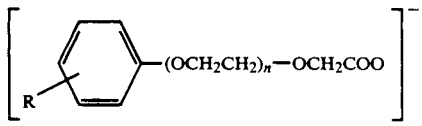

(IV)

and/or $$[R^1-(OCH_2CH_2)_n-OCH_2COO]^- \quad \text{(V)}$$

wherein R is an n- or branched alkyl group with 8 or 9 carbon atoms, $R^1$ is an n- or branched alkyl or alkenyl group with 12 to 20 carbon atoms, and n is a number such that approximately 21 to 76% of the molecular weight is in the $OCH_2CH_2$ groups.

The aforesaid sizing agents were employed at a pH of 4.5 to 6 and required relatively large amounts of aluminum sulfate to fix them to the fibers, contaminating the effluent. When up to now it was desired to size paper at a pH of 6 to 8, it was necessary to employ synthetic sizing agents, diketene derivatives for example, instead of rosins. Controlled sizing, however, was impossible with these synthetic sizing agents.

The object of the invention is to provide an invert size for the internal and surface sizing of paper, containing an aqueous dispersion of a fortified, unfortified, hydrogenated, or disproportionated and optionally esterified rosin or mixture of such rosins along with a dispersant that contains digested casein or an emulsifier of the general formula $$[R-(OCH_2CH_2)_n-O-A]^-{}_xM^{x+} \quad \text{(I)}$$

wherein R is an alkylphenyl, alkyl, or alkenyl group or a cycloalkyl group with condensed rings, A is a group of the formula $-CH_2COO$ or $-SO_3$, $M^{x+}$ is a cation, x is 1 or 2, and n is a number such that approximately 21 to 76% of the molecular weight of the anion is in the $-OCH_2CH_2$ groups, practical for sizing paper over a wider pH range of 4 to 8, and without the drawbacks of synthetic sizing agents, meaning that the sizing can be controlled.

This object is attained in accordance with the invention in that the dispersant also contains cationic starch.

It has, surprisingly, been confirmed that the size in accordance with the invention works satisfactorily over a pH range of 6.0 to 7.5, makes the paper more hydrophobic, and, compared with other sizes, requires considerably less aluminum sulfate to fix it to the fibers, which accordingly reduces contamination of the effluent from the paper mill. The effluent will also be less contaminated by this product in that it has, as compared with other sizes, a much lower biochemical and chemical oxygen demand.

The invert size in accordance with the invention preferably contains in the aqueous dispersion 5 to 50% by weight of rosin or a mixture of rosins and 1 to 15% by weight and especially 6 to 12% by weight of dispersant in terms of the rosin or mixture of rosins, with the remainder consisting of water, up to 100% by weight, whereby the ratio of the weight of the casein or emulsifier of Formula I to the cationic starch in the dispersant ranges from 20:80 to 80:20.

The invert size in accordance with the invention also contains a cationic starch in the dispersant in addition to the known casein or the known emulsifier of Formula I, which comprises known emulsifiers of Formulas II through V. The cationic starch replaces some of the previously employed casein or emulsifier of Formula I, makes the paper more hydrophobic within the neutral range, especially at a pH range from 6 to 7.5, promotes the action of the protective colloid, and improves the retention of the size or mineral fillers to the fibers. Since the cationic starch does not by itself act as a protective colloid, it was surprising to discover that it promotes the protective-colloid action of the casein. An especially preferred ratio for the weight of the casein or emulsifier of Formula I to the cationic starch in the dispersant ranges from 36:65 to 65:35. Outstanding results for example are obtained at a weight ratio of 50:50.

Cationic starches that can be employed in accordance with the invention are in themselves known and commercially available. They can be obtained for example by cationizing starch, potato starch or corn starch for example, with a known cationizer, glycidyltrimethylammonium chloride, 3-chloro-2-hydroxypropyltrimethylammonium chloride, or the corresponding triethyl compounds for example. The cationization binds positively charged anion groups to the starch molecule through ether bridges.

Cationic starches are already employed apart from paper size as flocculants and retention agents in papermaking. This known use of cationic starch is admittedly accompanied by a slight improvement in the hydrophobicity of the paper. When, however, the cationic starch is employed in the dispersant in the invert size in accordance with the invention, its hydrophobicity-improving effect on the paper is surprisingly about 100 times as powerful.

The rosin employed in the invert size in accordance with the invention can be any commercially available type of rosin—wood rosin, gum rosin, tall oil, or mixtures of two or more of these rosins in the raw or refined state for example. Rosins that tend to crystallize can be treated at elevated temperatures with formaldehyde or paraformaldehyde in the presence of an acid catalyst, toluene-p-sulphonic acid for example, in a way that is known to one of skill in the art. Thus, rosin treated with formaldehyde can be employed and is to be considered a rosin in the sense employed herein.

An adduct-reaction product of rosin with an acidic compound containing the radical

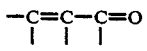

that has been obtained by reacting the rosin with the acidic compound at elevated temperatures, usually 150° to 210° C., is employed as a fortified rosin. Enough of the acidic compound will be employed to obtain a fortified rosin containing approximately 1 to approximately 30% by weight and preferably approximately 5 to approximately 12% by weight of the added acidic compound based on the fortified rosin. Methods of preparing fortified rosins are described in U.S. Pat. Nos. 2,628,918 and 2,684,300.

Examples of acidic compounds with a

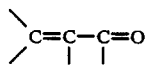

radical that can be employed to prepare the fortified rosin are the $\alpha,\beta$-unsaturated organic acids and their readily available anhydrides, particularly fumaric acid, maleic acid, acrylic acid, acrylamide, maleic anhydride, itaconic acid, itaconic anhydride, citraconic acid, and citraconic anhydride. The preferred adduct-forming acid is fumaric acid. Mixtures of acids can optionally be employed to prepare the fortified rosin. Mixtures of different fortified rosins can also be employed. Thus, for example, a mixture of the acrylic acid adduct to rosin and of the fumaric acid adduct to rosin can be employed to prepare the invert sizes in accordance with the invention. Finally, the esters of the aforesaid rosins with amino alcohols—triethanolamine, triisopropanolamine, or tributanolamine for instance—or with glycerine, glycol, or polyglycols, are appropriate for preparing the invert size in accordance with the invention. When a polyglycol is employed as an esterification agent, polyethyleneglycols with molecular weights of 190 to 1050 are preferably employed.

The rosin can optionally be mixed with known loaders—waxes, especially paraffin and microcrystalline wax, hydrocarbon resins, including those derived from petroleum hydrocarbons and terpenes, spindle oils, or polyglycols for example. This can be done in the melt or in solution, with up to approximately 100% by weight and preferably 30 to 50% by weight of the loader mixed in based on weight of the rosin. Some of the rosin can also be replaced with an extender. Tall oil derivatives for instance can be employed as an extender, which can be employed in amounts of approximately 30 to 50% by weight based on the weight of the rosin.

The invention can also be carried out with mixtures of fortified and unfortified, hydrogenated, or disproportionated rosins and with mixtures of fortified rosin, extenders, and/or loaders and unfortified, hydrogenated, or disproportionated rosins.

Mixtures of fortified, unfortified, hydrogenated or disproportionated rosins will contain approximately 0 to 100% fortified rosin and approximately 100 to 0% unfortified, hydrogenated, or disproportionated rosin. Mixtures of fortified rosin, rosin and rosin extenders will contain approximately 25 to 49% fortified rosin and approximately 0 to 25% extenders for the fortified rosin.

If a mixture of rosins is employed, the mixture can contain any of the foregoing rosins, fortified or unfortified, and optionally also partly or practically completely esterified, hydrogenated or disproportionated, or even polymerized.

In preparing the invert size in accordance with the invention an aqueous solution or dispersion of the dispersant is initially prepared. The casein or the emulsifier of Formula I, the cationic starch, and an acidic or basic digesting agent such as formic acid, an amino alcohol such as triethanolamine, potassium hydroxide solution, sodium hydroxide solution, ammonia or borax are mixed with water and heated. It is preferable to take water, stir in the digesting agent, and then add the casein or Formula I emulsifier and the cationic starch, subsequent to which the mixture is heated to 80° C. for example. As previously mentioned herein the Formula I emulsifier can be one of the known emulsifiers of Formulas II through V. The $M^{x+}$ cation in Formula I can for example be an alkali metal ion such as $Na^+$ or $K^+$, a hydrogen ion, an ammonia ion or a triethanolammonium ion.

The action of the cationic starch can optionally be augmented by also adding a cationic resin to the dispersant, which can also be considered a protective colloid. One example of an appropriate cationic resin is a urea-formaldehyde cationized with 3-chloro-2-hydroxypropyl-trimethylammonium chloride, 3-chloro-2-hydroxypropyl-triethylammonium chloride, or another known cationizing agent.

The resulting aqueous solution or dispersion of the dispersant or protective colloid is then added to the rosin or mixture of rosins, which has previously been melted and saponified by adding small amounts of a saponifier such as sodium hydroxide solution, potassium hydroxide solution or triethanolamine. The rosin or mixture of rosins is preferably melted at approximately 160° C. and cooled subsequent to saponification to approximately 120° C. before the dispersant is added. Once the saponified rosin has been mixed with the protective colloid, the mixture is diluted with water to the desired level, inducing the inversion.

The invention will now be described with reference to the accompanying drawing, which is a plot of ink flotation time versus content of size for several different size compositions, in conjunction with the following illustrative examples wherein parts are by weight unless otherwise expressed.

EXAMPLE 1

A. Preparation of a rosin fortified with maleic anhydride

A mixture of 91 parts of tall oil and 9 parts of maleic anhydride was stirred and heated to 190° C. Once the reaction was complete the batch was cooled to room temperature.

B. Preparation of the protective colloid solution 1 part of formic acid was stirred into 80 parts of water. 10 parts of casein and 10 parts of a starch cationized with 3-chloro-2-hydroxypropyl-trimethylammonium chloride (Cato Starch) were added. The mixture was heated to 80° C.

C. Preparation of the inverted size 200 parts of the rosin from A were heated to 160° C. and treated with 6 parts of 25% sodium hydroxide solution. The batch was cooled to 120° C., 60 parts of the protective colloid solution from B were added, and the batch was diluted to the desired percentage with water.

EXAMPLE 2

A. A rosin fortified with maleic anhydride and fumaric acid was prepared as described in Example 1A from 100 parts of tall oil, 3.5 parts of maleic anhydride, and 5.8 parts of fumaric acid at 210° C.

B. A protective colloid solution was prepared as described in Example 1B from 82.6 parts of water, 1.2 parts of triethanolamine, 8.7 parts of casein, and 8.7 parts of Cato Starch.

C. An inverted size was prepared as described in Example 1C from 100 parts of the resin from A, 2 parts of stearic acid, 4 parts of triethanolamine, and 60 parts of the protective colloid solution from B and diluted with 199 parts of water.

Employing the resulting size at a ratio of 2% bone-dry based on pulp to size paper at a pH of 7.2 resulted in an ink-flotation time of 1 minute.

EXAMPLE 3

A. A rosin fortified with maleic anhydride and fumaric acid was prepared as described in Example 1A from 120 parts of tall oil, 415 parts of balsamic resin, 23 parts of maleic anhydride, and 35 parts of fumaric acid at 210° C.

B. A protective colloid solution was prepared as described in Example 1B from 81 parts of water, 0.7 parts of formic acid, 9.5 parts of casein, and 9.5 parts of Cato Starch.

C. An inverted size was prepared as described in Example 1C from 100 parts of the resin from A, 2 parts of stearic acid, 4 parts of triethanolamine, and 60 parts of the protective-colloid solution from B and diluted with 199 parts of water.

Employing the resulting size at a ratio of 2% bone-dry based on pulp to size paper at a pH of 7.2 resulted in an ink-flotation time of 3.5 minutes.

EXAMPLE 4

A. A fortified rosin was prepared as described in Example 1A from 100 parts of tall oil, 2.6 parts of maleic anhydride, and 4.3 parts of fumaric acid at 210° C. A mixture of this rosin was stirred and heated to 200° C. with 4 parts of triethanolamine. Once the reaction was complete the batch was cooled to room temperature, resulting in a fortified rosin esterified with triethanolamine.

B. A protective colloid solution was prepared as described in Example 1B from 81 parts of water, 0.7 parts of formic acid, 9.5 parts of casein, and 9.5 parts of Cato Starch.

C. An inverted size was prepared as described in Example 1C from 100 parts of the resin from A, 2 parts of stearic acid, 4 parts of triethanolamine, and 60 parts of the protective-colloid solution from B and diluted with 199 parts of water.

Employing the resulting size at a ratio of 2% bone-dry based on pulp to size paper at a pH of 7.2 resulted in an ink-flotation time of 8 minutes.

EXAMPLE 5

A. A rosin fortified with maleic anhydride, fumaric acid, and acrylamide was prepared as described in Example 1A from 100 parts of tall oil, 3.5 parts of maleic anhydride, 5.8 parts of fumaric acid, and 3.3 parts of acrylamide at 210° C. A mixture of this rosin was stirred and heated to 200° C. with 4 parts of triethanolamine. Once the reaction was complete the batch was cooled to room temperature, resulting in a fortified rosin esterified with triethanolamine.

B. A protective colloid solution was prepared as described in Example 1B from 81 parts of water, 0.7 parts of formic acid, 9.5 parts of casein, and 9.5 parts of Cato Starch.

C. An inverted size was prepared as described in Example 1C from 100 parts of the resin from A, 2 parts of stearic acid, 4 parts of triethanolamine, and 60 parts of the protective colloid solution from B and diluted with 199 parts of water.

Employing the resulting size at a ratio of 2% bone-dry based on pulp to size paper at a pH of 7.2 resulted in an ink-flotation time of 13 minutes.

EXAMPLE 6

A. A fortified rosin was prepared as described in Example 1A from 100 parts of tall oil and 9 parts of maleic anhydride and esterified with 5 parts of triethanolamine as described in Example 5A.

B. A protective colloid solution was prepared as described in Example 1B from 81 parts of water, 0.7 parts of formic acid, 9.5 parts of casein, and 9.5 parts of Cato Starch.

C. An inverted size was prepared as described in Example 1C from 100 parts of the resin from A, 2 parts of stearic acid, 4 parts of triethanolamine, and 60 parts of the protective colloid solution from B and diluted with 199 parts of water.

Employing the resulting size at a ratio of 2% bone-dry based on pulp to size paper at a pH of 7.2 resulted in an ink-flotation time of 10 minutes.

EXAMPLE 7

A. A rosin was prepared as described in Example 4A.

B. A protective colloid solution was prepared as described in Example 1B from 82.6 parts of water, 1.2 parts of triethanolamine, 8.7 parts of casein, and 8.7 parts of Cato Starch.

C. An inverted size was prepared as described in Example 1C from 100 parts of the resin from A, 2 parts of stearic acid, 4 parts of triethanolamine, and 60 parts of the protective colloid solution from B and diluted with 199 parts of water.

Employing the resulting size at a ratio of 2% bone-dry based on pulp to size paper at a pH of 7.2 resulted in an ink-flotation time of 12 minutes.

EXAMPLE 8

A. A fortified rosin was prepared as described in Example 1A from 500 parts of tall oil, 14 parts of maleic anhydride, and 23 parts of fumaric acid and esterified with 25 parts of triethanolamine as described in Example 5A.

B. A protective colloid solution was prepared as described in Example 1B from 160 parts of water, 0.66 parts of formic acid, 20 parts of casein, and 20 parts of Cato Starch.

C. An inverted size was prepared as described in Example 1C from 300 parts of the resin from A, 6 parts of stearic acid, 12 parts of triethanolamine, and 180 parts of the protective colloid solution from B and diluted with 582 parts of water.

Employing the resulting size at a ratio of 2% bone-dry based on pulp to size paper at a pH of 7.2 resulted in an ink-flotation time of 8 minutes.

EXAMPLE 9

A. A rosin was prepared as described in Example 2A.

B. A protective colloid solution was prepared as described in Example 1B from 80 parts of water, 0.6 parts of formic acid, 8 parts of casein, and 12 parts of Cato Starch.

C. An inverted size was prepared as described in Example 1C from 100 parts of the resin from A, 2 parts of stearic acid, 4 parts of triethanolamine, and 60 parts of the protective colloid solution from B and diluted with 199 parts of water.

Employing the resulting size at a ratio of 2% bone-dry based on pulp to size paper at a pH of 7.2 resulted in an ink-flotation time of 4 minutes.

EXAMPLE 10

A. A rosin was prepared as described in Example 2A.

B. A protective colloid solution was prepared as described in Example 1B from 92 parts of water, 0.5 parts of formic acid, 9 parts of casein, and 9 parts of Cato Starch.

C. An inverted size was prepared as described in Example 1C from 100 parts of the resin from A, 2 parts of stearic acid, 4 parts of triethanolamine, and 60 parts of the protective colloid solution from B and diluted with 200 parts of water.

Employing the resulting size at a ratio of 2% bone-dry based on pulp to size paper at a pH of 7.2 resulted in an ink-flotation time of 4 minutes.

EXAMPLE 11

A. A rosin was prepared as described in Example 2A.

B. A protective colloid solution was prepared as described in Example 1B from 90 parts of water, 0.5 parts of formic acid, 4 parts of triethanolamine, 4 parts of nonylphenolpolyethyleneoxy-carboxylic acid, 4 parts of oleylpolyethylenoxycarboxylic acid, and 12 parts of Cato Starch.

C. An inverted size was prepared as described in Example 1C from 100 parts of the resin from A, 2 parts of stearic acid, and 60 parts of the protective colloid solution from B and diluted with 195 parts of water.

Employing the resulting size at a ratio of 2% bone-dry based on pulp to size paper at a pH of 6.8 resulted in an ink-flotation time of 0.42 minutes.

EXAMPLE 12

A. A rosin was prepared as described in Example 2A.

B. A protective colloid solution was prepared as described in Example 1B from 90 parts of water, 0.5 parts of formic acid, 4 parts of triethanolamine, 4 parts of nonylphenolpolyethylenoxycarboxylic acid, 4 parts of oleylpolyethylenoxycarboxylic acid, and 12 parts of Cato Starch.

C. An inverted size was prepared as described in Example 1C from 100 parts of the resin from A, 2 parts of stearic acid, and 60 parts of the protective colloid solution from B and diluted with 195 parts of water.

Employing the resulting size at a ratio of 2% bone-dry based on pulp to size paper at a pH of 6.8 resulted in an ink-flotation time of 0.5 minutes.

EXAMPLE 13

A. A rosin was prepared as described in Example 2A.

B. A protective colloid solution was prepared as described in Example 1B from 82.6 parts of water, 0.5 parts of 45% KOH, 12 parts of casein, and 6 parts of Cato Starch.

C. An inverted size was prepared as described in Example 1C from 100 parts of the resin from A, 2 parts of stearic acid, 3.8 parts of 26% KOH, and 60 parts of the protective colloid solution from B and diluted with 195 parts of water.

Employing the resulting size at a ratio of 2% bone-dry based on pulp to size paper at a pH of 7.2 resulted in an ink-flotation time of 1.5 minutes.

EXAMPLE 15

A. A rosin fortified with acrylamide was prepared by stirring and heating to 200° C. a mixture of 91 parts of tall oil and 9 parts of acrylamide and cooling to room temperature upon completion of the reaction.

B. A protective colloid solution was prepared by stirring 4 parts of triethanolamine followed by 3 parts of a urea-formaldehyde resin cationized with 3-chloro-2-hydroxypropyltriethylammonium chloride into 81 parts of water, 10 parts of casein, and 6 parts of Cato Starch were then added and the mixture heated to 80° C.

C. An inverted size was prepared as described in Example 1C from 200 parts of the resin from A, 4 parts of triethanolamine, and 60 parts of the protective colloid solution from B.

EXAMPLE 16

A fortified rosin esterified with glycerine was prepared by stirring and heating a mixture of 91 parts of the rosin from Example 1A or 14A and 9 parts of glycerine to 200° C. and cooling the batch to room temperature once the reaction was complete. An inverted size was prepared as described in Example 1C from 200 parts each of the foregoing esterified rosins, 6 parts of 25% NaOH or KOH or 4 parts of triethanolamine, and 60 parts of the protective colloid solution from either Example 1B, Example 14B, or Example 15B.

EXAMPLE 17

A fortified rosin esterified with glycol was prepared by stirring and heating a mixture of 91 parts of the rosin from Example 1A or 14A and 9 parts of glycol to 200° C. and cooling the batch to room temperature once the reaction was complete. An inverted size was prepared as described in Example 1C from 200 parts each of the foregoing esterified rosins, 6 parts of 25% NaOH or KOH or 4 parts of triethanolamine, and 60 parts of the protective colloid solution from either Example 1B, Example 14B, or Example 15B.

EXAMPLE 18

A fortified rosin esterified with polyethylene glycol was prepared by stirring and heating a mixture of 91 parts of the rosin from Example 1A or 14A and 9 parts of polyethylene glycol (with a mean molecular weight of 400) to 200° C. and cooling the batch to room temperature once the reaction was complete. An inverted size was prepared as described in Example 1C from 200 parts each of the foregoing esterified rosins, 6 parts of 25% NaOH or KOH or 4 parts of triethanolamine, and 60 parts of the protective colloid solution from either Example 1B, Example 14B, or Example 15B.

EXAMPLE 19 (COMPARISON)

This reference example represents the preparation of an invert size with a protective-colloid solution that contains only casein and no cationic starch.

A. A rosin was prepared as described in Example 2A.

B. A protective colloid solution was prepared as described in Example 1B from 158 parts of water, 4.8 parts of 45% KOH, and 29 parts of casein.

C. An inverted size was prepared as described in Example 1C from 600 parts of the resin from A, 2 parts of stearic acid, 18 parts of 26% KOH, and 180 parts of the protective colloid solution from B.

Employing the resulting size at a ratio of 2% bone-dry based on pulp to size paper at a pH of 7.2 resulted in an ink-flotation time of 0.1 minutes.

The drawing is a graph of the ink-flotation times of samples of pulp sized with the sizes from Examples 2 through 7 and with the comparison size from Example 19 as a function of the percent of size added, based on dry weight.

The chemical (COD) and biochemical ($BOD_5$) oxygen demands were also determined for the sizes from Example 7 and Comparison Example 19. The COD was determined in accordance with DIN 38 409, Part 14 and the $BOD_5$ in accordance with DIN 38 409, Part 51. The following results were obtained:

| Size | COD | $BOD_5$ |
|---|---|---|
| Example 19 (comparison) | 745 g/l | 474 g/l |
| Example 7 | 191 g/l | 58 g/l |

The size in accordance with Example 7 of the invention accordingly exhibited considerably lower chemical and biochemical oxygen demands than the size from Reference Example 19.

It will be appreciated that the instant specification and claims are set forth by way of illustration and not limitation, and that various modifications and changes may be made without departing from the spirit and scope of the present invention.

What is claimed is:

1. In an invert size for the engine and tub sizing of paper, comprising an aqueous dispersion of a fortified, hydrogenated or disproportionated and optionally esterified rosin or mixture of such rosins and of a dispersant that contains digested casein or an emulsifier of the formula $$[R-(OCH_2CH_2)_n-O-A]^-{}_xM^{x+} \quad (I)$$

wherein R is an alkylphenyl, alkyl, or alkenyl group or a cycloalkyl group with condensed rings, A is a group of the formula $-CH_2COO$ or $-SO_3$, $M^{x+}$ is a cation, x is 1 or 2, and n is a number such that approximately 21 to 76% of the molecular weight of the anion is in the $-OCH_2CH_2$ groups, the improvement which comprises including cationic starch in the dispersion as a dispersant, the dispersion by weight comprising about 5 to 50% of the rosin or mixture of rosins and 1 to 15% of the dispersant based on the rosin or mixture of rosins, with the remainder consisting essentially of water, the ratio of the weight of casein or emulsifier of Formula I to the weight of cationic starch in the dispersant ranging from about 20:80 to 80:20, the ratio of the weight of rosin: cationic starch ranging from about 1:0.0280 to 1:0.0710.

2. An invert size according to claim 1, wherein the dispersion contains 6 to 12% by weight of the dispersant based on the rosin or mixture of rosins.

3. An invert size according to claim 1, wherein the ratio of the weight of casein or emulsifier of Formula I to the weight of the cationic starch ranges from about 35:65 to 65:35.

4. An invert size according to claim 1, wherein the cationic starch is starch cationized with glycidyltrimethylammonium chloride, 3-chloro-2-hydroxypropyltrimethylammonium chloride, or 3-chloro-2-hydroxypropyltriethylammonium chloride.

5. An invert size according to claim 1, containing rosin in the form of a rosin fortified with at least one of fumaric acid, maleic anhydride and acrylamide.

6. An invert size according to claim 1, containing rosin in the form of a rosin esterified with an amino alcohol.

7. An invert size according to claim 1, containing rosin in the form of a rosin esterified with triethanolamine.

8. An invert size according to claim 1, containing rosin in the form of a rosin esterified with glycerine, glycol or a polyglycol.

9. An invert size according to claim 1, further containing a urea-formaldehyde cationic resin in an amount to augment the dispersing effect of the cationic starch.

10. In the production of paper wherein to a dispersion of paper pulp a size and fixing agent are added and the pulp is thereafter formed into paper, the improvement wherein the size comprises a dispersion according to claim 1.

11. Sized paper produced by the process of claim 10.

* * * * *